United States Patent [19]

Moore

[11] Patent Number: 4,906,366

[45] Date of Patent: Mar. 6, 1990

[54] SKIMMER SYSTEM

[75] Inventor: Odis A. Moore, Odessa, Tex.

[73] Assignee: Amoco Corporation, Chicago, Ill.

[21] Appl. No.: 287,816

[22] Filed: Dec. 21, 1988

[51] Int. Cl.[4] ..... E02B 15/04

[52] U.S. Cl. ..... 210/242.3; 210/923

[58] Field of Search ..... 210/776, 121, 122, 923, 210/242.3

[56] References Cited

U.S. PATENT DOCUMENTS

| | | | |
|---|---|---|---|
| 360,593 | 4/1887 | Hyatt | 210/121 |
| 1,450,545 | 4/1923 | Hans | 210/122 |
| 3,438,205 | 4/1969 | Lindstrom | 210/242.3 |
| 3,534,859 | 10/1970 | Amero et al. | 210/923 |
| 3,578,171 | 5/1971 | Usher | 210/923 |
| 3,642,140 | 2/1972 | Parker | 210/923 |
| 3,707,232 | 12/1972 | Harrington et al. | 210/242.3 |
| 3,722,687 | 3/1973 | Stebbins et al. | 210/923 |
| 3,759,390 | 9/1973 | McCombie | 210/776 |
| 3,876,540 | 4/1975 | Falxa | 210/776 |
| 3,901,811 | 8/1975 | Finch | 210/242.3 |
| 3,922,225 | 11/1975 | Strain | 210/242.3 |
| 4,032,449 | 6/1977 | De Visser et al. | 210/923 |
| 4,208,287 | 6/1980 | Brieck | 210/242.3 |
| 4,257,889 | 3/1981 | Wober et al. | 210/242.3 |
| 4,301,008 | 11/1981 | Baffert et al. | 210/923 |
| 4,378,921 | 3/1983 | Ward et al. | 210/923 |
| 4,431,536 | 2/1984 | Thompson | 210/242.3 |
| 4,512,883 | 4/1985 | Thompson | 210/123 |

FOREIGN PATENT DOCUMENTS

| | | |
|---|---|---|
| 748737 | 4/1970 | Belgium . |
| 1230561 | 12/1987 | Canada . |
| 304705 | 4/1918 | Fed. Rep. of Germany . |

*Primary Examiner*—Richard V. Fisher
*Assistant Examiner*—Christopher Upton
*Attorney, Agent, or Firm*—Scott H. Brown; Fred E. Hook

[57] ABSTRACT

A skimmer system comprising a skimmer device for collecting a surface contaminant layer from a liquid component, pumping means for transferring the surface contaminant layer from the skimmer device to a remote location, and positioning means for maneuvering the skimmer device about the surface contaminant layer.

6 Claims, 3 Drawing Sheets

22
15
9
17
11
7
13

SKIMMER SYSTEM

FIELD OF THE INVENTION

The invention pertains to the separation of a surface contaminant layer from a liquid. More specifically, the invention relates to the removal of an oil skim from a collection pit containing at least oil and water.

BACKGROUND OF THE INVENTION

Lined pits are commonly used in the oil and chemical industries to collect liquid contaminants as a result of malfunctions of treating or process equipment. Many times the liquid contaminant contained in these pits comprises oil in significant quantities. Environmental regulations require that the oil be removed from the pit promptly.

In the past, vacuum trucks were normally used to remove the oil skim. The disadvantage of this method is the oil is usually not recovered in a timely fashion so that it can be treated and sold through normal production. This can result in a significant loss of revenue.

Another method of removing the oil skim from the collection pit is the use of skimming devices that range in cost from Ten Thousand Dollars ($10,000) to Fifteen Thousand Dollars ($15,000) and that are not very effective.

There is a need for a system for skimming oil off the surface of a collection pit containing at least oil and water which is relatively simple in construction and which is highly efficient in gathering the oil.

SUMMARY OF THE INVENTION

One aspect of this invention is a skimmer system comprising a skimmer device for collecting a surface contaminant layer from a liquid, pumping means for transferring the surface contaminant layer from the skimmer device to a remote location, and positioning means for maneuvering the skimmer device about the surface contaminant layer. The skimmer device comprises a buoyant support base having a plurality of pontoon members, a frame rigidly connected to the pontoon members, a funnel connected to the frame and disposed between the pontoon members, and a means for adjusting the funnel in the vertical direction. The support base and the frame can be made of a buoyant material, such as a synthetic thermoplastic polymer, for example, polyvinyl chloride.

Another aspect of this invention is a method for skimming a surface contaminant layer from a liquid. The method comprises positioning the skimmer device on the surface of the contaminant layer, activating the skimming device to remove the surface contaminant layer and repositioning the skimmer device and continuing to remove the surface contaminant layer until the liquid is completely free of the surface contaminant layer. The skimmer device can be activated by turning on the pumping means.

DESCRIPTION OF THE PREFERRED EMBODIMENT

Figure 1:
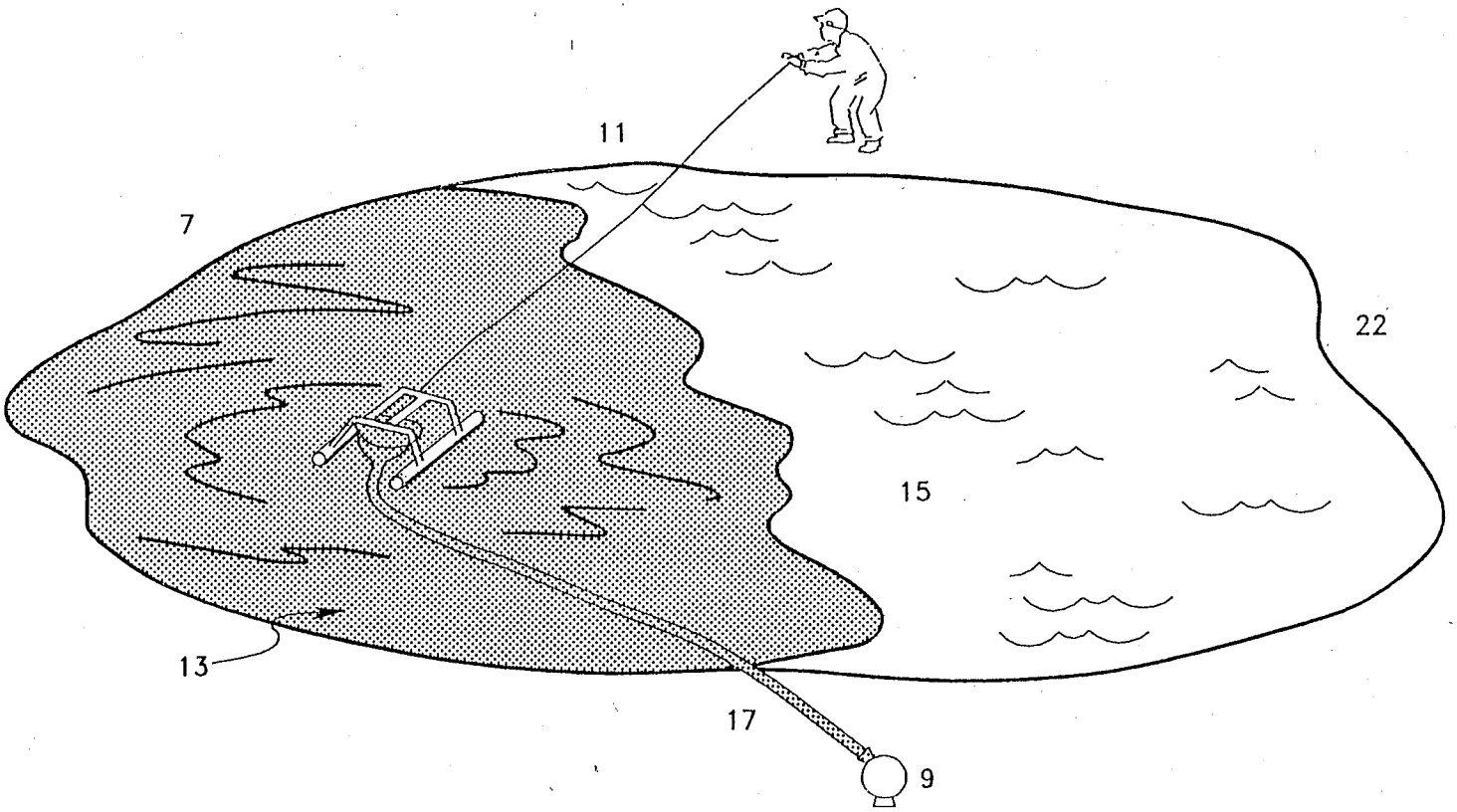
FIG. 1 is a view of the method of using apparatus of this invention to remove a surface contaminant layer from a liquid contained in a collection pit.

As illustrated in FIG. 1, the skimmer system comprises a skimmer device 7 for collecting a surface contaminant layer 13 from a liquid 15, pumping means 9 for transferring the surface contaminant layer 13 to a remote location, and positioning means 11 for maneuvering the skimmer device 7 about the surface contaminant layer 13.

The skimmer device 7 comprises a buoyant support base 1 having at least two buoyant pontoon members 5, a frame 3 rigidly connected to the support base 1, a funnel 18 adjustably connected to the frame 3, and an adjusting means for moving the funnel 18 in the vertical direction so that the top edge of the funnel 18 will travel at a position slightly below the level of the surface contaminant layer 13 in the pit 22. The support base 1 supports the funnel 18 in an upright position which is adjustable. The surface contaminant layer 13 can be oil and the liquid 15 can be water.

Figure 2:
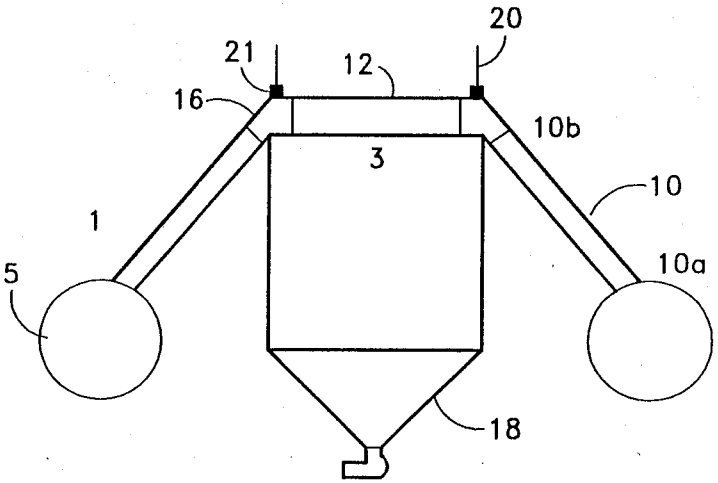
FIG. 2 is a front view of the apparatus of this invention.
Figure 3:
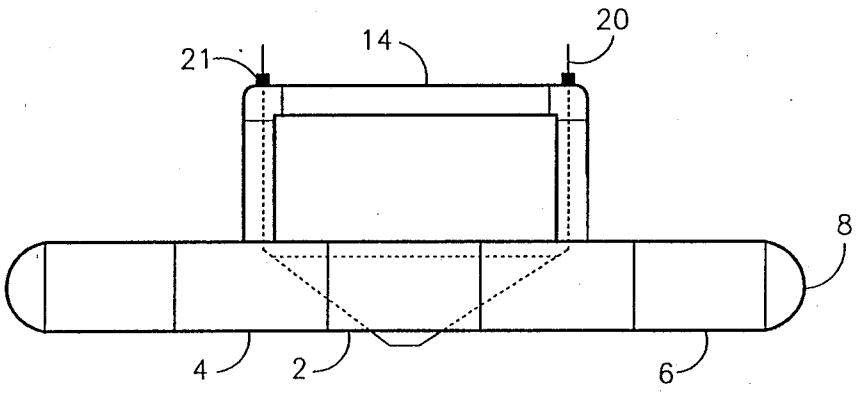
FIG. 3 is a side view of the apparatus of this invention.

In the preferred embodiment, as illustrated in FIGS. 2 and 3, the support base 1 comprises a pair of buoyant pontoon members 5 and a frame member 3. The frame 3 and the pontoon member 5 should be constructed out of buoyant material, such as a synthetic thermoplastic polymer, for example polyvinyl chloride.

Each pontoon member 5 comprises of a center nipple 2, a plurality of tees 4 connected to each end of the center nipple 2, a plurality of outer nipples 6 connected coaxially to the tees 4, and a pipe cap 8 connected to each outer nipple 6. Each pontoon member comprises a center nipple having a first end and a second end, a first and second tee each having a first, second and third end, a first outer nipple and a second outer nipple each having a first and second end, and a first pipe cap and a second pipe cap. The first end of the center nipple is coaxially connected to the first end of the tee. The second end of the center nipple is coaxially connected to the first end of the second tee. The second end of the first tee is coaxially connected to the first end of the first outer nipple. The second end of the second tee is coaxially connected to the first end of the second outer nipple. The second end of the first outer nipple is coaxially connected to the first pipe cap. The second end of the second outer nipple is coaxially connected to the second pipe cap.

The frame member 3 comprises a plurality of slant members 10, a plurality of cross braces 12, and a center brace 14. Each slant member 10 comprises a section of pipe having a first end **10*a* and a second end 10*b*. The first end 10*a* is connected to the tee 4 located in the pontoon member 5; and, the second end 10*b* is connected coaxially to cross brace 12**.

The cross braces 12 are connected to the slant members 10 by elbows 16 , and can be connected to each other by a center brace 14 that is substantially parallel to the pontoon members 5.

The skimmer device 7 further includes a funnel 18 that is supported by the frame member 3 of support base 1, and a means for adjusting the funnel 18 in the vertical direction. The funnel 18 is supported by the support base 1 using a plurality of bolts 20 penetrating the frame 3 and the funnel 18. The bolts are held in place by a plurality of nuts 21. The funnel 18 can be adjusted in the vertical direction by loosening the nuts 21, sliding the funnel 18 up or down along the bolts 20 and refastening the nuts 21. The funnel 18 can be adjusted such that the top edge of the funnel 18 will travel at a position slightly below the level of the surface contaminant layer in the pit 22. The adjustable feature allows the funnel 18 to skim oil over a wide range of fluid densities and skin thicknesses.

The pumping means 9 for transferring the surface contaminant layer to remote location can be an air-operated positive displacement pump. The preferred pumping means is a sandpiper double diaphragm air-driven pump. The air can be provided by a Quincy model 216 2-horsepower 60 gallon air compressor. A flexible hose 17 can be used to connect the skimmer device 7 to the pumping means 9. The pumping means 9 can be located at the edge of the collection pit 22. The pumping means 9 and the air supply can be portable or stationary, and gasoline or electric power. The discharge from the skimmer 7 can be directed back through the production system to timely recover the oil.

The means for positioning the skimmer device can be a tether line attached on one end to the skimmer and on the other end to an operator. Another aspect of this invention is a method for skimming a surface contaminant layer from a liquid comprising the steps of positioning the skimmer device 7 on the surface layer, activating the skimmer device to remove the surface contaminant layer, and repositioning the skimmer device 7 and continuing to remove the surface contaminant layer until the fluid is completely free of the surface contaminant layer.

The use of the funnel adjustment and the air-operated pump provides a great deal of flexibility in the amount of water return with the oil and rate at which the skimmer device 7 operates. This will be helpful during the winter months when the viscosity of oil increases.

An example of the number and sizes of equipment suitable for use in the skimmer device 7 are listed below: four 4-in. PVC pipe caps 8 for ends; four 4-in. by 1-½-in. PVC pipe tees 4; four 1-½-in. PVC 45° elbows 16; and two 5/16 all threaded bolt stalks 20. The preferred dimensions of the skimmer device 7 are 41 inches in length, 11.5 inches high, and 31 inches in width.

I claim:

1. A skimmer system, comprising: a skimmer device for collecting a surface contaminant layer from a liquid; pumping means for transferring the surface contaminant layer from the skimmer device to a remote location; and positioning means for maneuvering the skimmer device about the surface contaminant layer;

the skimmer device comprising a buoyant support base having a plurality of pontoon members, a frame rigidly connected to the pontoon members, a funnel connected to the frame and disposed between the pontoon members, and means for adjusting the funnel in the vertical direction; and wherein each pontoon member comprises a central nipple having a first end and a second end, a first tee and a second tee each having a first, a second and a third end, a first outer nipple and a second outer nipple each having a first and a second end, and a first pipe cap and a second pipe cap, the first end of the center nipple coaxially connected to the first end of the first tee, the second end of the center nipple coaxially connected to the first end of the second tee, the second end of the first tee coaxially connected to the first end of the first outer nipple, the second end of the second tee coaxially connected to the first end of the second outer nipple, the second end of the first outer nipple coaxially connected to the first pipe cap, and the second end of the second outer nipple coaxially connected to the second pipe cap.

2. An apparatus of claim 1 wherein the frame comprises at least one slant member having a first end and a second end, the first end connected to the third end of a tee the second end connected to a cross brace.

3. An apparatus of claim 2 wherein the means for adjusting the funnel is a plurality of bolts penetrating the frame and the funnel, said bolts being secured to the frame and the funnel by nuts.

4. An apparatus of claim 3 wherein the positioning means comprises a tether attached to the skimmer device.

5. An apparatus of claim 4 further comprising a flexible hose having a first end and a second end, the first end connected to the funnel and the second end connected to the pumping means.

6. An apparatus of claim 5 wherein the pumping means comprises a positive displacement pump.

* * * * *